United States Patent [19]

Inoue et al.

[11] Patent Number: 4,459,668

[45] Date of Patent: Jul. 10, 1984

[54] AUTOMATIC TRAIN CONTROL DEVICE

[75] Inventors: Hitoshi Inoue; Kazuhiko Nagase, both of Tokyo; Yoshihiko Sato, Ohmiya, all of Japan

[73] Assignee: Japanese National Railways, Tokyo, Japan

[21] Appl. No.: 242,256

[22] Filed: Mar. 10, 1981

[30] Foreign Application Priority Data

Mar. 31, 1980 [JP] Japan ..... 55-40555
Mar. 31, 1980 [JP] Japan ..... 55-40457

[51] Int. Cl.[3] ..... G06F 15/20; B61L 3/08

[52] U.S. Cl. ..... 364/426; 364/436; 246/182 B

[58] Field of Search ..... 364/426, 436; 246/182 B

[56] References Cited

U.S. PATENT DOCUMENTS

| | | | |
|---|---|---|---|
| 4,005,838 | 2/1977 | Grundy | 364/426 |
| 4,015,082 | 3/1977 | Matty et al. | 364/426 |
| 4,066,230 | 1/1978 | Nohmi et al. | 246/182 B |
| 4,095,764 | 6/1978 | Osada et al. | 364/436 |
| 4,302,811 | 11/1981 | McElhenny | 364/426 |

FOREIGN PATENT DOCUMENTS

| | | | |
|---|---|---|---|
| 2626617 | 12/1977 | Fed. Rep. of Germany | 364/426 |
| 2382043 | 9/1978 | France | 364/426 |
| 2382360 | 9/1978 | France | 364/426 |
| 54-36010 | 10/1979 | Japan | 364/426 |

OTHER PUBLICATIONS

Hiroshi Yoshimura, "Signalling and Telecommunication for the New Takaido Line" from *Japanese Railway Engineering,* Mar. 1963, vol. 4, No. 1 (pp. 30–33).

*Primary Examiner*—Felix D. Gruber
*Attorney, Agent, or Firm*—Wenderoth, Lind & Ponack

[57] ABSTRACT

An automatic train control device which has a detector for detecting whether a newly received train speed signal instruction is for instructing the train to run at a lower speed than that according to an earlier signal while the train is running at a speed within the range according to the instruction received by an earlier signal, and thus finds itself running at a speed exceeding the speed according to the newly received instruction. A differential speed detector, which is connected to the signal detector, detects the excess of the train speed over the speed according to the newly received instruction. A memory outputs one braking instruction from among a plurality of stored optimum braking patterns to a device which controls the application of the brake according to the output from the memory, the memory output being in response to an excess train speed.

7 Claims, 9 Drawing Figures

AUTOMATIC TRAIN CONTROL DEVICE

The present invention relates to an automatic train control (ATC) device, and more specifically to an improved speed control device for an ATC device equipped train in which the train, while running at a speed in the speed range as set by a received signal, receives a second signal instructing the train to run at a lower speed and thereby finds itself running at a speed exceeding the speed according to the newly received instruction.

BACKGROUND OF THE INVENTION AND PRIOR ART

The speed of a train equipped with an ATC device is controlled by instructions given to the train from a signal section continuously laid out on the ground in the direction of movement of the train. When the train receives a signal instructing it to run within a particular speed range in one signal section, in this signal section the train is controlled so as to run at a speed in the range according to said signal. If the speed as set by the instructions is exceeded, the ATC device detects the excess speed and the train is automatically braked so that the train speed will diminish to the proper value at least before the train reaches the end of said signal section.

If a train moves into the next section at a speed above the upper limit of the speed allowed in one section and instructions for a lower speed are given for said next section, then an instruction will be issued to apply a braking force large enough to brake the train to a speed lower than the speed according to the instruction. Said braking force is usually of a specific magnitude. In the case of an ATC device for the high speed Tokyo-Osaka-Hiroshima line and some other lines in Japan, the braking force is designed to be variable in preset speed ranges. Even with such an arrangement, however, the braking force caused to be exerted by the ATC device is specific within a specific speed range. The magnitude of this specific braking force is selected on the assumption that the train runs to the section boundary at the upper limit of the range of speeds in the preceding section. Therefore, even when the train speed exceeds the speed set by the instructions by only a small amount, a large braking force may act and in most such cases the speed of the train is decelerated to an extent more than necessary. Moreover, the speed of the train approaching the boundary may not be near the upper limit, so that the braking force appropriate for such an upper limit speed is not appropriate for lower speeds. This frequently results in excessive reduction of the ride comfort and the running speed and possible damage to the wheels which may skid during such braking.

OBJECTS AND BRIEF SUMMARY OF THE INVENTION

The first object of the present invention is therefore to provide an arrangement by which, when a train reaches the signal section boundary while moving not only at the upper limit of the allowed speed but also at any lower speed, the train is braked in response only to the extent that an excess of the train speed over the value specified for the new section and in a manner appropriate for the speed of approach and thereby is not caused to brake more than necessary, whereby the ride comfort and the train operation are improved and at the same time an unnecessary skidding of the wheels is prevented.

The second object of the present invention is to provide an arrangement for detecting when a new speed instruction signal is received at a section boundary, as compared with a speed instruction signal received elsewhere, e.g. in an emergency, so that the train will not be abruptly braked when an abnormal situation develops in a section ahead of the train.

To this end, the train control device of the present invention has a detector for detecting whether a newly received train speed signal instruction is for instructing the train to run at a lower speed than that according to an earlier signal while the train is running at a speed within the range according to the instruction received by an earlier signal, and thus finds itself running at a speed exceeding the speed according to the newly received instruction; a differential speed detector which detects the excess of the train speed over the speed according to the newly received instruction; a memory for storing braking instructions to be issued in response to an excess train speed; and a device which controls the application of the brake according to the output from said memory.

BRIEF DESCRIPTION OF THE DRAWINGS

Other objects, features and advantages of the present invention will become more apparent from the following detailed description taken in conjunction with the attached drawings, wherein:

FIG. 4(*b*) is a block diagram of an embodiment of the ATC device of the present invention;

DETAILED DESCRIPTION OF THE INVENTION

Figure 1:
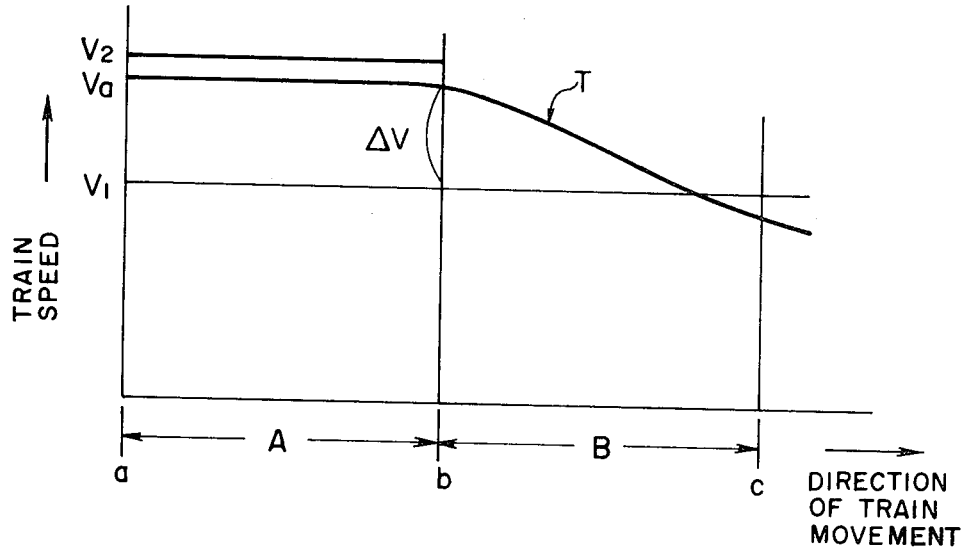
FIG. 1 is a schematic diagram illustrating an example of train speed control in a signal section by means of an ATC device.

Referring to FIG. 1, conventional train speed control by ATC is shown in sufficient detail so that the present invention can be understood.

In FIG. 1 the abscissa is the direction of train movement and the ordinate is the train speed, the curve T indicating the speed of the train during operation.

Suppose in the signal section A of the track, i.e. the interval a-b, the train is operated under the control of the ATC device so as to run at a speed, say Va, which is not in excess of the upper limit of the speed $V_2$ according to the instruction supplied by the signal in that section, and a new instruction to operate at a speed $V_1$ is issued at a point b at the time of entry of the train into the new signal section B (interval b-c). The signal to the train is thus renewed at point b. At the start of signal section B the train is moving at a speed which exceeds the speed $V_1$ according to the instruction by $\Delta V$, and the ATC device therefore acts to issue a braking instruction, whereupon the train begins to slow down so that its speed will be lower than $V_1$ midway of the section B, and thereafter the ATC device acts to release the brake. This is the general process of speed control carried out by an ATC device. In this case, however, the braking force applied by the ATC device at point b is such that the train passing said point at speed $V_2$, i.e. the upper limit of the speed allowed in the section just cleared, so that the excess of speed is a maximum, will be braked at the end c of the new section B to the speed $V_1$ specified for the new section B. Therefore, when the actual excess $\Delta V$ is less than the maximum, the train will be braked more than necessary. It is desirable that the braking force in such a case just match the magnitude of $\Delta V$, thereby preventing the train from being overbraked.

The present invention seeks to overcome the above drawbacks of the prior art ATC device by making the ATC device braking force match the excess of the speed.

Preferred embodiments of the present invention are described in detail hereinafter.

Figure 2:
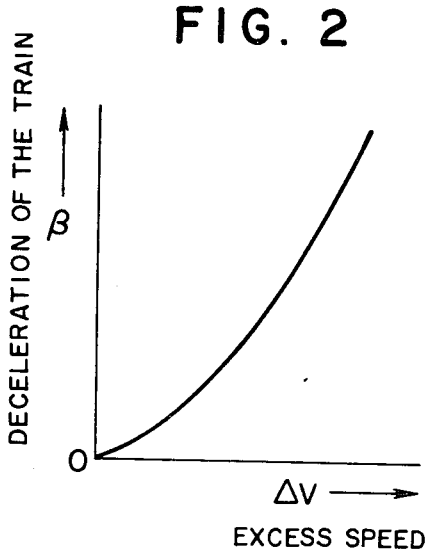
FIG. 2 is a schematic diagram illustrating a pattern of speed reduction by an ATC device controlled brake in response to an excess speed.

It is well-known that the relation between the excess speed $\Delta V$ and the deceleration $\beta$ of the train required for cancelling said excess speed within the limits of a signal section having a definite length and making the train run at a specified speed can be expressed as a quadratic curve as shown in FIG. 2, neglecting the time of the idle running of the train under braking.

For a common train it can be said, while allowing for slight differences depending on the brake device employed by the train and the speed range in any particular case, that the instruction for the level of braking and the braking force developed thereby, i.e. deceleration, are proportional to each other.

Figure 3:
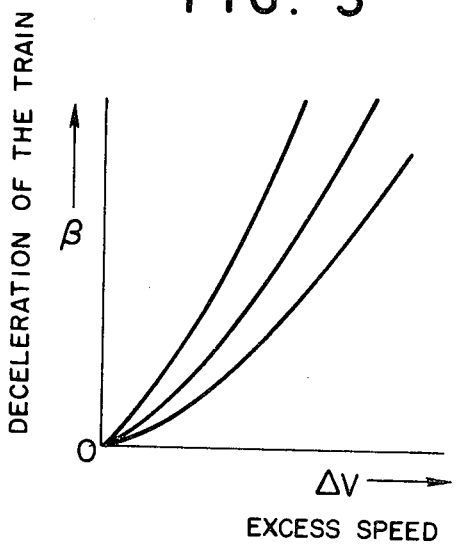
FIG. 3 is a schematic diagram illustrating a braking pattern according to braking instructions issued by an ATC device in response to an excess speed.

Thus, when a train passing the signal section boundary receives a new signal instructing it to run at a lower speed, and as a result the speed thereof exceeds by $\Delta V$ the speed according to the newly received instruction, the relation of said excess speed $\Delta V$ and the necessary braking level instruction necessary to brake the train to eliminate the excess speed can be approximately expressed by one of a group of quadratic curves as shown in FIG. 3, where the ordinate is the braking level instruction and the abscissa is the excess speed $\Delta V$. The respective curves are for appropriate braking patterns to overcome $\Delta V$ depending on the speed at which $\Delta V$ occurs. That is, one curve can be for the braking pattern where $\Delta V$ occurs when the newly received instruction i.e.—the renewal instruction speed information is, say, 210 km/hr, while another curve can be for the braking pattern where $\Delta V$ occurs when the newly received instruction is only 70 km/hr.

By using a group of such curves, the needed braking force can be optimized; namely, when the pattern of deceleration needed to just brake the train to the new speed differs depending on the speed at which $\Delta V$ occurs, a group of curves such as illustrated in FIG. 3 for the braking to overcome $\Delta V$ at various speeds can be plotted, and when the idle run under braking cannot be ignored, said curves can be appropriately corrected. When braking is needed, the brake actuating can be according to the appropriate curve, and the braking force applied will be just sufficient to reduce $\Delta V$ to zero and the train will be braked to the speed according to the new instruction no later than when the end c of the section B is reached.

Figure 4:
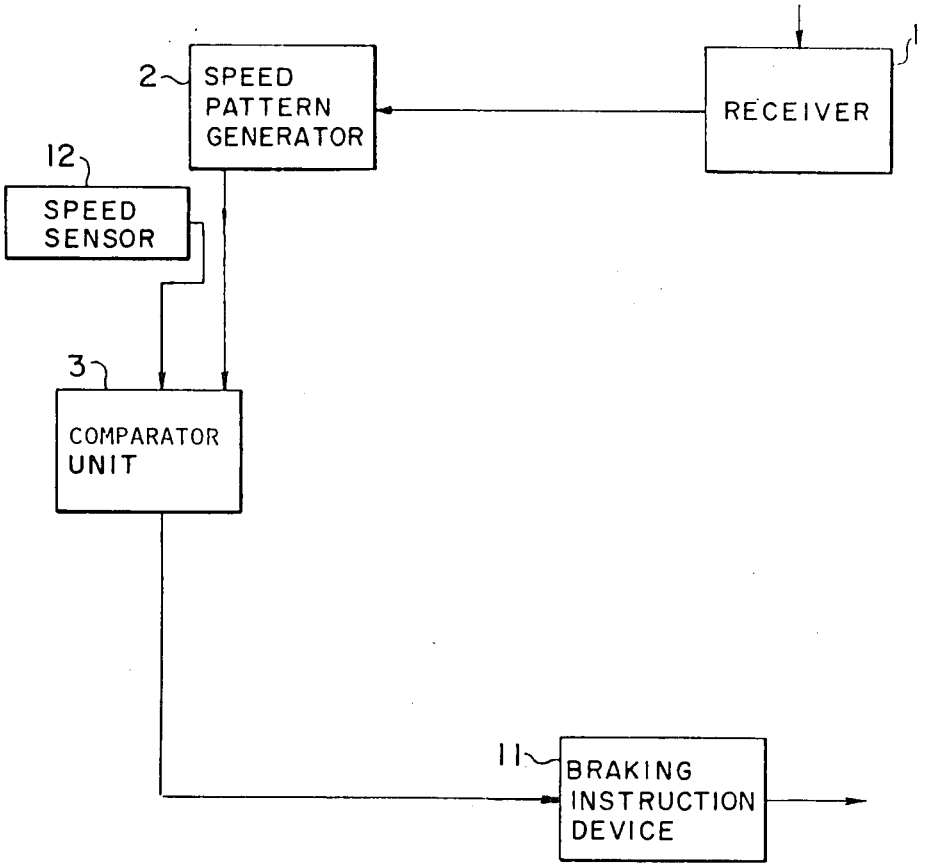
FIG. 4 (a) PRIOR ART
FIG. 4(*a*) is a block diagram of a conventional ATC device.
Figure 4:
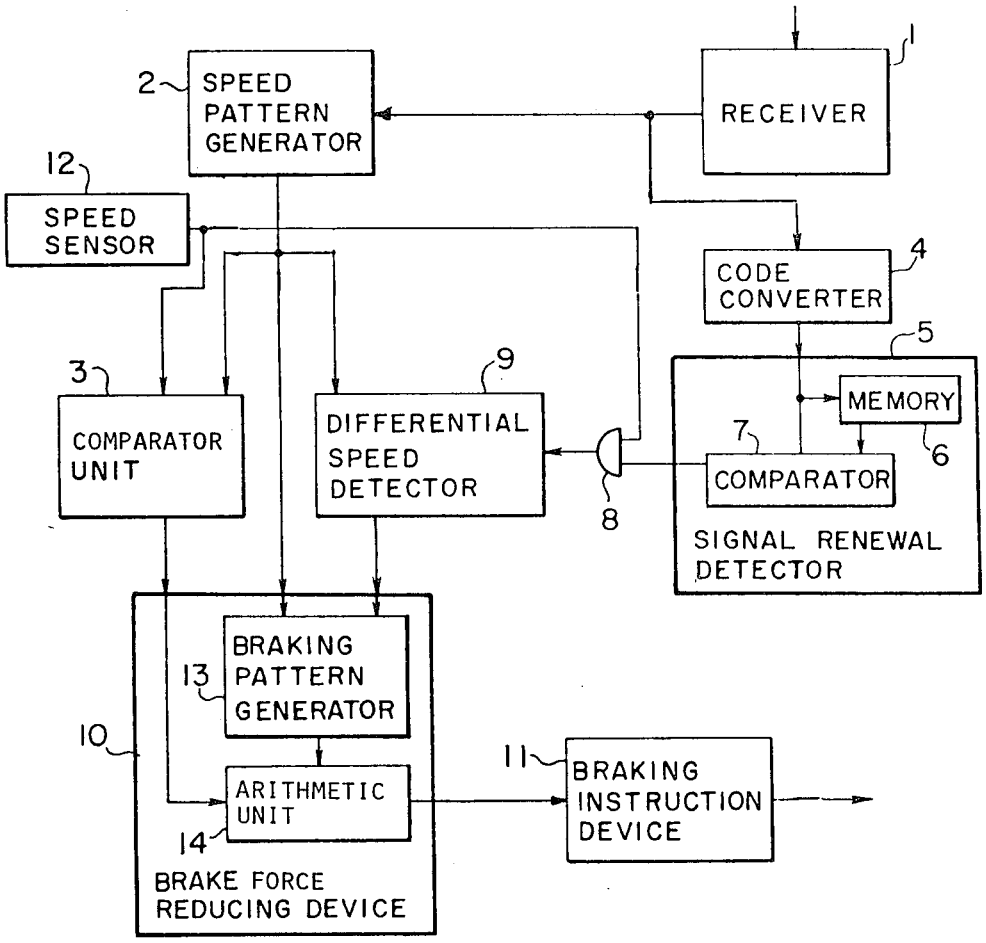

A conventional ATC device is illustrated in FIG. 4(*a*). A prior art receiver 1 is mounted on a train (not shown). Said receiver 1 receives a signal current flowing in the signal section on which the train is running, and a speed instruction according to said signal current is supplied to the receiver 1 depending on the relative position of said train to the preceding train and the route being prepared for said train.

The speed instruction signal received by said receiver 1 goes to the prior art speed pattern generator 2, which generates a speed pattern corresponding to the signal received. Said pattern is delivered to the prior art comparator unit 3. Said unit 3 also receives speed information from a prior art speed sensor or generator 12 which senses the train speed from the rotational speed of the wheel axle. Said comparator unit 3 determines from a signal from the speed pattern generator and the information on the actual running speed contained within the speed sensor 12 output whether the train is running at a speed in excess of the ATC instruction or not. If the actual speed exceeds the desired speed according to the speed instruction, the excess is detected and immediately an order to apply the brake is issued to the prior art brake level instruction device 11.

The above arrangement is widely known for carrying out automatic speed control. The present invention shown in FIG. 4(*b*) adds the following new features to this the aforementioned prior art arrangement as illustrated in FIG. 4(*a*).

A conventional code converter 4 is provided and is supplied with the ATC signal from the ATC receiver 1, and it converts it to a code previously specified for the particular ATC signal. This preset code expresses the ATC signal in a form which makes the arithmetic operation easy. In the prior art, speed instruction information of this kind is in the form of a specific frequency for each speed as to which an instruction is to be given, and from the frequency of a received signal the particular speed is detected. According to the present invention, when a signal current of a frequency which gives a speed instruction of 70 km/hr is received, the signal of said frequency is converted by the code converter to 70, thereby facilitating the arithmetic operation. The encoded ATC signal is delivered to a signal renewal detector 5 having an internal conventional memory 6 and conventional comparator 7. In the signal renewal detector 5, the received encoded instruction signal is stored in the memory 6. When a new signal is received, such as when the train enters a new section, the comparator 7 compares the new encoded signal, say 30, with the earlier encoded signal, say 70, held in said memory 6. When the new signal instructs the train to run at a lower speed than before, said signal renewal detector 5 detects this instruction and accordingly provides a control signal to a conventional AND gate 8. The speed information originating from the speed sensor or generator 12 at this time is then supplied to a convention differential speed detector 9 through the gate 8, the differential speed detector 9 determines the amount by which the actual speed of the train at the instant of receipt of the new signal exceeds the speed information from the speed pattern generator 2. The excess speed information $\Delta V$ thus determined is delivered to the brake force reducing device 10, which comprises a conventional braking pattern generating mechanism 13. The braking pattern generating mechanism 13 stores a plurality of brake level instruction curves corresponding to various renewal speed instructions which have been proven by testing to eliminate excess speed by the time the train reaches the end of the section and depending on the speed at which the excess speed occurs, as in FIG. 3. From among said curves, the braking pattern generating mechanism 13 selects and generates only one curve which corresponds to the renewal speed pattern information received from the speed pattern generator 2. By said selected curve and the excess speed information $\Delta V$ from the differential speed detector 9, the braking pattern generator 13 determines the brake level instruction needed for the received $\Delta V$, i.e.—a brake level instruction which will brake the train before the end of the section of the speed according to the newly received signal.

As stated above, the speed pattern generator 2, which receives an ATC signal from receiver 1, sends out three speed patterns in total, one each to the comparator unit 3, the braking pattern generator 13 and the differential speed detector 9. It is well known to those skilled in the art that a prior art speed pattern generator 2 suffices to yield three outputs from one input.

When the conventional arithmetic unit 14 receives a brake level instruction from the pattern generating mechanism 13, the brake instruction issued from the comparator unit 3 is reduced in the arithmetic unit 14 to an appropriate braking force instruction which reduces the speed by a desired amount before the train reaches the end of the section. The appropriate braking force instruction thus obtained is transmitted from the brake force reducing device 10 to the prior art braking instruction device 11. Then, in the conventional prior art way, braking instructions are issued to the whole train, thereby applying the brakes for ATC. If the desired speed reduction is attained before the train reaches the end of the section, comparator unit 3 detects this and ceases to output the brake instruction, whereupon the braking action is stopped and the train no longer decelerates. The braking force is stepped down to match the excess of speed only when a new signal is received by ATC device in the manner described above and such a new signal is for a lower speed, and accordingly an optimized braking action takes place.

In the above sequence, while there is no output from the differential speed detector 9 to the pattern generating mechanism 13, the arithmetic unit 14 will not convert the brake instruction from the comparator unit 3 to said appropriate braking force instruction.

In the conventional ATC device, a new signal calling for a lower speed is usually received at a section boundary; however, when an emergency occurs in a section ahead of the train, a new signal may be received midway in a section. For instance, if a rail in a signal section ahead of a running train is indicated as being broken after said train has passed the entrance of a certain section, then the section with the broken rail will be indicated as being shunted due to the failed rail. As a result, said section will indicate to the ATC system that it is being occupied by a preceding train, although there is actually no train existing there. Thus, the running train in said certain section will receive a new signal calling for a lower speed midway in said certain section.

In a conventional ATC system, in the above described case, the normal brake action as described above will take place to slow the train, unless the new signal is one which calls for an emergency halt of the train. Therefore, in the event of such an emergency, it may turn out that the train speed cannot be reduced to the desired speed before it reaches the end of the section.

This is a situation which is likely to occur even in the above described example of the operation of the present invention. Moreover, in said example, the situation will be more serious, because the braking force produced from the ATC device will be that in response to the excess of speed over the speed in the next section. The problem can be resolved if the arrangement is such that in said situation the braking force will be applied in response to the excess of speed only when the signal is renewed at the section boundary and such braking action will not be produced in other cases, i.e., in an emergency situation.

A specific arrangement to be added to the above described device for this purpose will be described in connection with FIGS. 5–7.

Current receivers 15 and 16 installed under the body of the railroad car 26 ahead of the leading wheel W are spaced at a particular distance in the direction of train movement. The current receiver 15 is electrically connected to the signal receiver 17, and the current receiver 16 is electrically connected to the signal receiver 18, and the signal receivers are connected to the signal identification device 25. In the signal identification device 25 are provided memory circuits 19 and 20 and a time interval measuring circuit 21 to which the outputs of the signal receivers are applied, a comparator 22 to which the output of the time interval measuring circuit is applied. AND circuit 23 receives the outputs of recording circuits 19 and 20 and AND circuit 24 receives the outputs of AND circuit 23 and comparator 22.

With this arrangement, the train 26, running in the direction of the arrow, is shown as about to move from the signal section A into the signal section B. When the signal $S_A$ in the section A and the signal $S_B$ in the section B are different from each other, the signal current received by the current receivers 15 and 16 changes at the boundary between sections A and B. As described above, said receivers 15 and 16 are separated a specific distance in the direction of train movement, and accordingly the receiver 16 will receive the signal current after receiver 15 after a time lag corresponding to the speed of the train 26 and the distance between the receivers 15 and 16. When both receivers 15 and 16 are receiving only the signal $S_A$, the output $R_{A1}$ from the signal receiver 17 and the output $R_{A2}$ from the signal receiver 18 can both be considered equal to 1, and when neither receives the signal $S_B$, the output $R_{B1}$ from said receiver 17 and the output $R_{B2}$ from said receiver 18 are both equal to 0. When both receivers 15 and 16 are receiving only the signal $S_B$, the outputs $R_{A1}$ and $R_{A2}$ from the signal receivers are both equal to 0 while the outputs $R_{B1}$ and $R_{B2}$ therefrom are both equal to 1.

Figure 6:
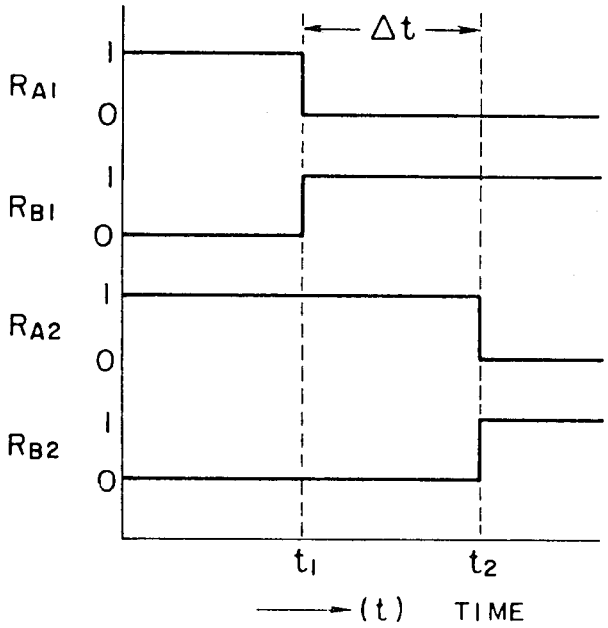
FIG. 6 is a schematic diagram illustrating an example of a new train speed signal being received by two receivers.

The sequence of outputs when the receivers cross the boundary between sections A and B will be as indicated in FIG. 6. Namely, when the current receiver 15 passes the boundary at time $t_1$, the output $R_{A1}$ from the signal receiver 17 will turn from 1 to 0, while the output $R_{B1}$ therefrom will turn from 0 to 1. When the current receiver 16 passes said boundary at time $t_2$, the output $R_{A2}$ from the signal receiver 18 will turn from 1 to 0, while the output $R_{B2}$ therefrom will turn from 0 to 1.

If the speed of the train passing the signal section boundary is v and the spacing of the receivers 15 and 16 in the direction of movement of the train is l, the time lag between signal change between the receiver 15 and 16, Δt, can be expressed, assuming identical performance of the two sets of current receivers and signal receivers, as follows:

$$\Delta t = t_2 - t_1 = \frac{l}{v}$$

In the signal identification device 25, the output from the signal receiver 17 is stored in the memory circuit 19. The output from the signal receiver 18 is stored in the memory circuit 20. Depending on the change of output from the receiver 18, the contents of said memory circuits 19 and 20 are supplied to AND circuit 23. If the contents of said circuits 19 and 20, i.e. the outputs from said receivers 17 and 18, agree with each other, said contents are supplied to the AND circuit 24. At the same time, the time lag between the change in output from the receiver 17 to the change in output from the receiver 18 is measured by the time interval measuring circuit 21.

Meanwhile the vehicle speed is detected by a conventional speed sensor 12 which is directly coupled to the wheel W and this information is fed into a conventional time calculator 28 which comprises a clock circuit and an integration circuit. In the time calculator 28, the speed information is converted to a series of pulses and the pulse-to-pulse interval is measured by said clock circuit and said integration circuit, whereby the time taken by the train to cover the distance between the two current receivers 15 and 16 at the speed according to the speed sensor 12 is calculated and the result is supplied to the comparator 22. The comparator 22 compares the input from the time calculator 28 with the input Δt from the time interval measuring circuit 21, and when such time is found to match the time lag Δt between changes of the output from the signal receivers 17 and 18, the comparator delivers an output to the AND circuit 24 indicating that the new signal is one issued at the section boundary. Otherwise, the comparator delivers no output, which indicates that the new signal is one issued other than at a section boundary.

Figure 7:
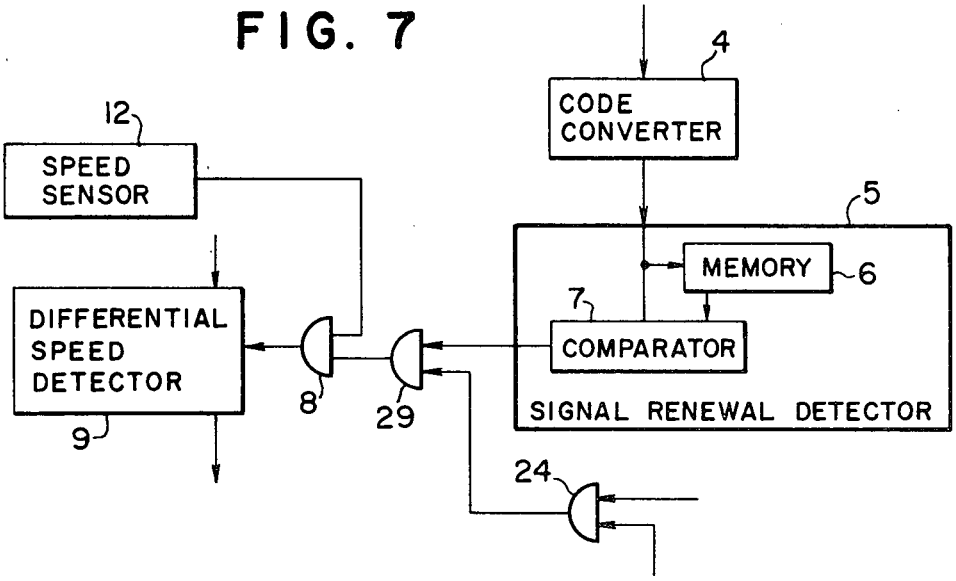
FIG. 7 is a circuit diagram explaining the relation between the first embodiment and the second embodiment.

Upon receiving the output from the comparator 22, the AND circuit 24, when it is also receiving output from AND circuit 23, supplies an output to an AND circuit 29 which, as shown in FIG. 7, is connected between the signal renewal detector 5 and the AND gate 8. This in turn causes AND circuit 29 to supply the output from the signal renewal detector 5 the differential speed detector 9 of FIG. 4.

Figure 5:
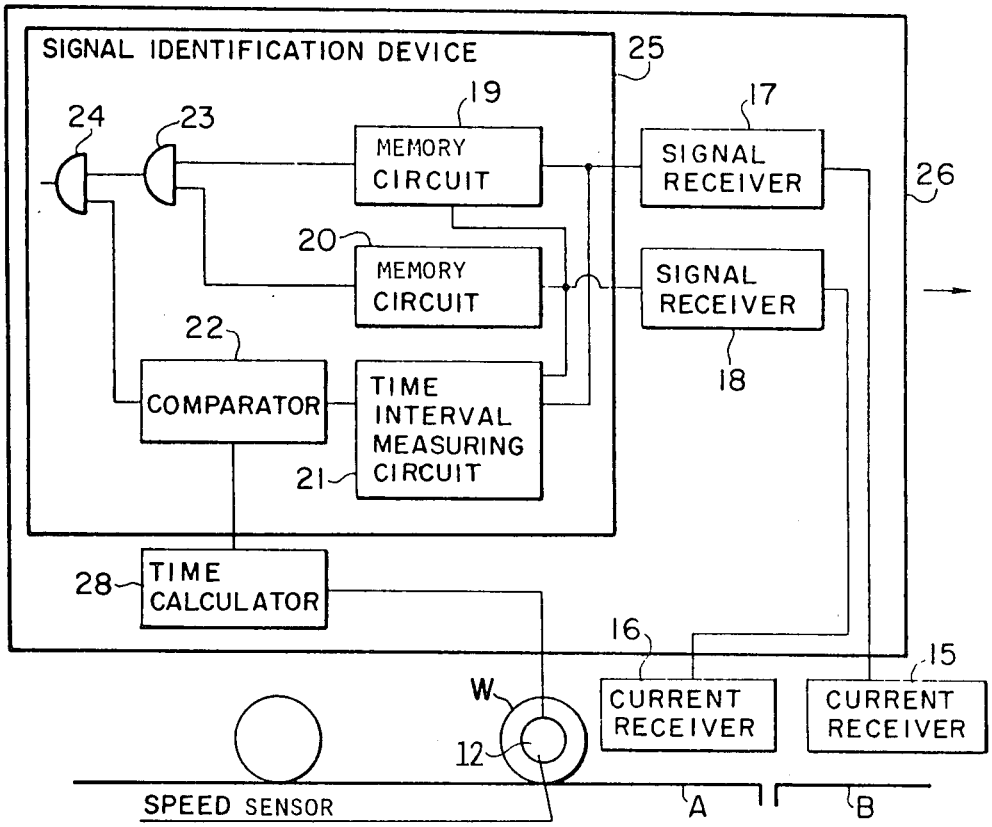
FIG. 5 is a block diagram of a second embodiment of the ATC device of the present invention.

When no output is produced by the comparator 22, the AND circuit 24 of FIG. 5, and AND circuit 29 of FIG. 7 and the gate 8 of FIGS. 4 and 7 produce no output and thus the differential speed detector 9 does not operate. In such circumstances the speed control is according to the prior art ATC device within the dotted line enclosure in FIG. 4.

Figure 8:
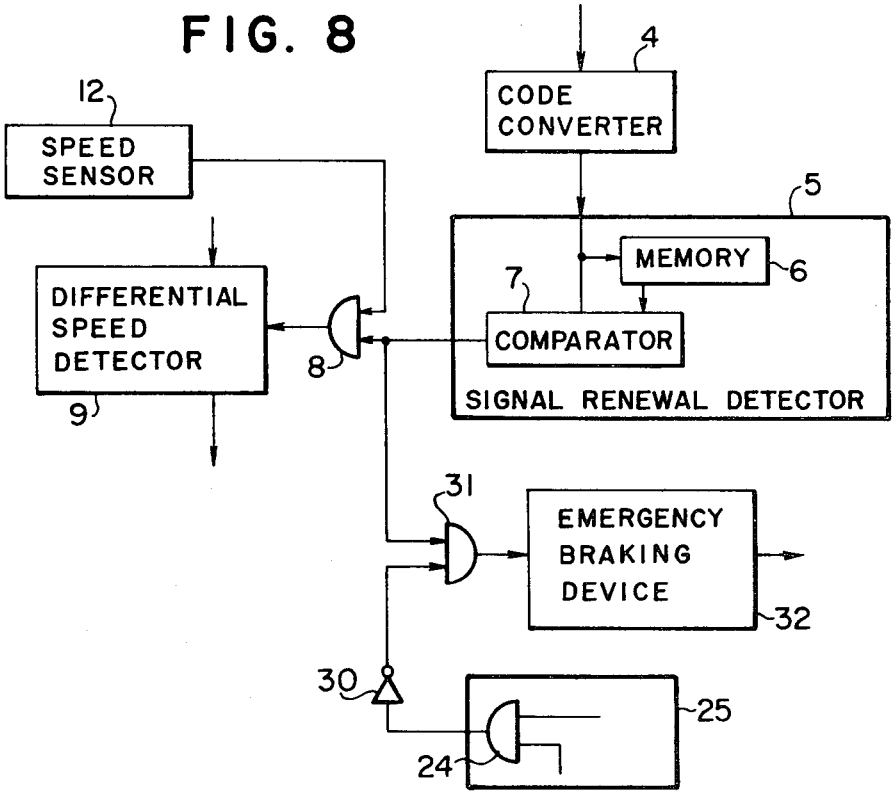
FIG. 8 is a block diagram showing a third embodiment of the ATC device of the present invention.

An alternative to the arrangement of FIG. 7 is possible. As illustrated in FIG. 8, the AND circuit 24 of the signal identification circuit 25 can be connected through a logic inverter circuit 30 to the input side of an AND circuit 31 the output of which is connected to an emergency braking instruction device 32. At the same time, the output of the signal renewal detector 5 as shown in FIGS. 4 and 7 is connected to the input of the AND circuit 31. When no output comes from the AND circuit 24 as shown in FIGS. 5 and and 7 and output from the signal renewal detector 5 comes to the input of the AND circuit 31, the AND circuit 31 produce an output, thereby bringing into action the emergency braking instructions device 32 to apply emergency braking to the whole train.

The example illustrated in FIG. 4 uses patterns of braking in response to an excess of speed which patterns are prepared in advance, and a braking level instruction is issued according to these patterns. This is, however, not the only possibility. A prescribed braking force can be produced in response to an excess of speed by using a conventional memory. As for detection of a new signal, alternatives to the method described in connection with FIG. 4 are possible.

What is claimed is:

1. In an automatic train control system having a receiver for receiving speed instruction signals, a speed pattern generator for generating a speed pattern according to said instruction signals, said generator being connected to an output of said receiver, a train speed sensor, a comparator unit connected to outputs of said speed pattern generator and said speed sensor for determining whether the speed of the train exceeds the desired speed according to the generated speed pattern, and a braking instruction device for actuating the braking means of the train, a device for optimizing the braking force applied according to the amount by which the train speed exceeds the desired speed according to a newly received speed instruction signal, said device comprising: a signal detector for receiving said speed instruction signals from said receiver and for detecting whether a newly received speed instruction signal is instructing the train to run at a speed which is lower than the desired speed according to an earlier received speed instruction signal and for producing an output signal when such a condition is detected; a differential speed detector for receiving said outputs of said speed sensor and said speed pattern generator for determining the amount by which the speed of the train exceeds the desired speed according to the newly received speed instruction signal; a signal responsive means which is responsive to an output from said signal detector for supplying said output of said speed sensor to said differential speed detector in response to said output from said signal detector; a brake force reducing device including means for storing a plurality of braking force patterns, each of said plurality of patterns respectively corresponding to one of a plurality of different speeds of the train and which is appropriate for braking the train to compensate for the excess train speed within the length of a track section over which braking is to be accomplished, said brake force reducing device being connected to said outputs of said differential speed detector and said speed pattern generator and said arithmetic unit, wherein said brake reducing device generates an output which is supplied to said braking instruction device and which corresponds to the braking force which is optimum for excess speed of the train.

2. A device as claimed in claim 1, wherein said signal responsive means comprises an AND gate.

3. A device a claimed in claim 1, said signal detector comprises a memory means for storing a previously received speed instruction signal and a comparator for comparing said stored speed instruction signal with a newly received speed instruction signal and for providing an output when said stored newly received speed instruction signal is less than said stored previously received speed instruction signal.

4. A device as claimed in claim 1, said brake force reducing device comprises a brake pattern generator for storing braking force patterns, said generator receiving said outputs from said differential speed detector and said speed pattern generator, and a converter connected to an output from said brake force pattern generator for receiving brake pattern information from said brake pattern generator and for generating a braking force signal therefrom, said converter receiving an output from said comparator unit for causing said converter to output said braking force signal.

5. A device as claimed in claim 1, further comprising a speed instruction sequence detecting means for detecting whether a newly received speed instruction signal has been received at a boundary between track sections and for producing an output signal in response thereto, said speed instruction signal sequence detecting means being connected to said brake force reducing device to allow said device to supply an output to said braking instruction device only when said speed instruction signal sequence detecting means is producing an output signal.

6. A device as claimed in claim 5, wherein said speed instruction signal sequence detecting means includes an AND gate for receiving an output signal therefrom, and wherein said AND gate has an input connected to the output from said signal detector and has an output connected to said responsive means.

7. A device as claimed in claim 5, wherein said speed instruction signal sequence detecting means includes a logic inverter circuit and a further AND gate to which the output of said logic inverter circuit is connected, and wherein said further AND gate has an input connected to said signal detector for receiving an output signal therefrom and having an output connected to a further braking means for the train.

* * * * *